United States Patent [19]

Paluch

[11] 4,106,837

[45] Aug. 15, 1978

[54] ELECTRICAL CONNECTOR

[75] Inventor: Edward S. Paluch, Elmwood Park, Ill.

[73] Assignee: Reliable Electric Company, Franklin Park, Ill.

[21] Appl. No.: 749,062

[22] Filed: Dec. 9, 1976

[30] Foreign Application Priority Data

Jan. 12, 1976 [FR] France ..... 76 00558

[51] Int. Cl.[2] ..... H01R 9/08

[52] U.S. Cl. ..... 339/98; 339/220 R

[58] Field of Search ..... 339/97-99, 339/220, 221

[56] References Cited

U.S. PATENT DOCUMENTS

| | | | |
|---|---|---|---|
| Re. 26,208 | 5/1967 | Tupper | 339/97 R |
| 2,811,702 | 10/1957 | Narozny | 339/220 R |
| 3,223,960 | 12/1965 | Ruehlemann | 339/221 R |
| 3,611,264 | 10/1971 | Ellis, Jr. | 339/99 R |
| 3,862,792 | 1/1975 | Jayne | 339/221 R |

FOREIGN PATENT DOCUMENTS

| | | | |
|---|---|---|---|
| 2,269,799 | 11/1975 | France | 339/97 R |

*Primary Examiner*—Joseph H. McGlynn

*Attorney, Agent, or Firm*—Olson, Trexler, Wolters, Bushnell & Fosse, Ltd.

[57] ABSTRACT

An electrical connector is disclosed comprising a connector block provided with an opening therethrough and an electrically conductive terminal having a portion thereof projecting outwardly of the block at the opening. The electrical terminal is also provided with means in its outwardly projecting part for terminating an electrical conductor thereon. The part of the terminal in the block has opposed side faces having at least two opposed bosses formed thereon for retaining the terminal in the block.

10 Claims, 8 Drawing Figures

FIG. 1
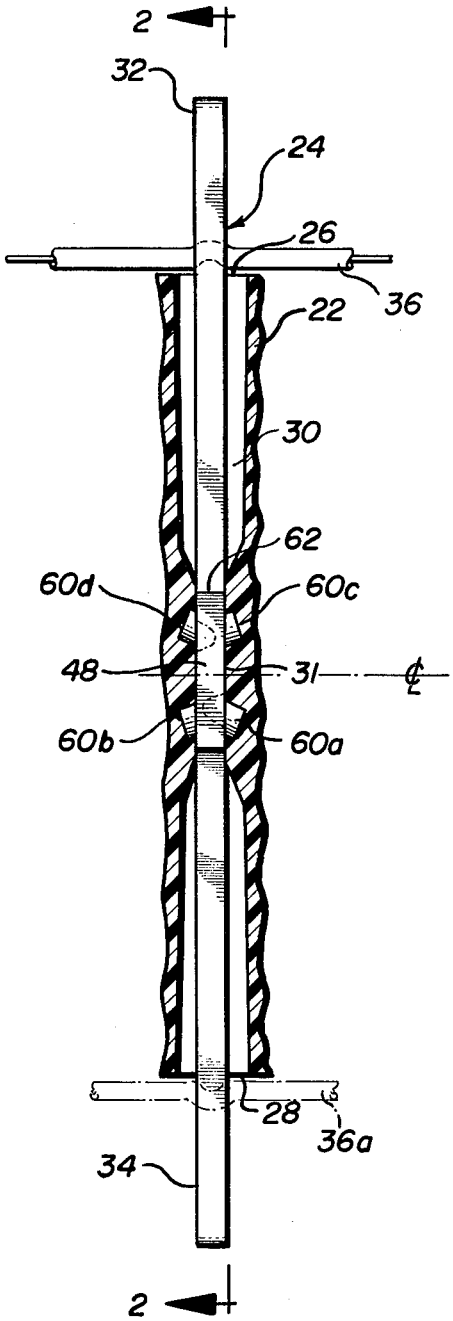
FIG. 2
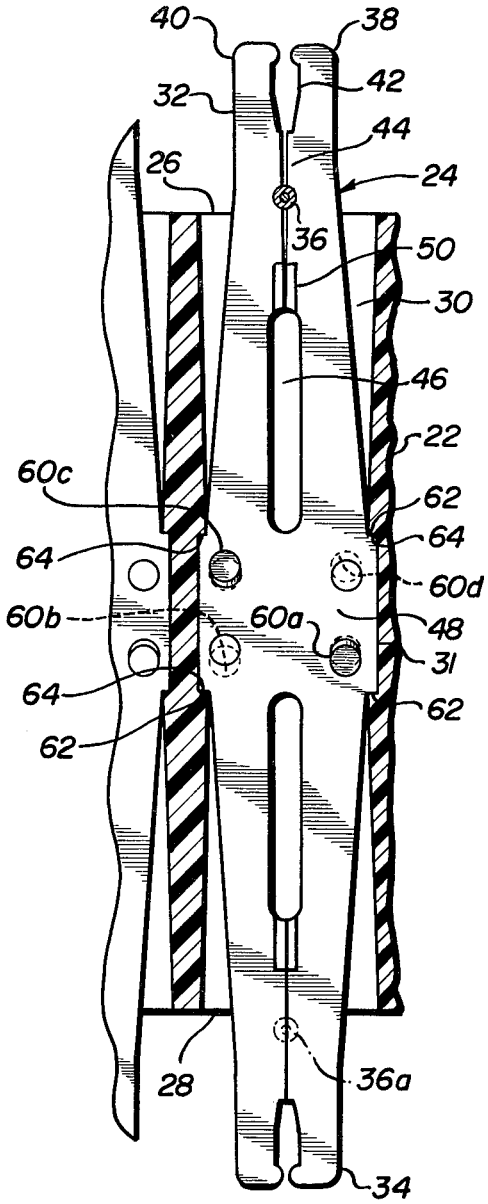
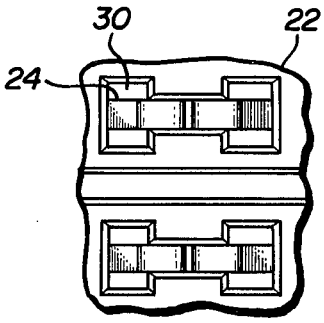
FIG. 3

ELECTRICAL CONNECTOR

REFERENCE TO THE PRIOR ART

Reference is hereby made to United States application of William S. Sedlacek and Louis Reffay assigned to the assignee of the present invention, Ser. No. 659,796 filed Feb. 20, 1976 and the prior art cited therein.

BACKGROUND OF THE INVENTION

The present invention relates to an electrical connector, and more specifically to an electrical connector of the type commonly used for connecting telephone and like communications circuits.

Electrical connectors of the foregoing type typically comprise an electrical terminal of metallic or other conductor composition in conjunction with a connector block of insulator material such as a dielectric plastic composition. The electric terminal is provided with means for retaining the terminal in the connector block and outwardly projecting portions having means for terminating electrical conductors thereon. It is desirable to provide an electrical terminal and an insulator block so constructed that the terminal may be fitted into a retaining pocket or opening within the block by a combination of press or interference fits between the terminal and the internal surfaces thereof. Thus, electrical conductors may be fitted by a force acting thereon to the terminating means of the projecting part of the electrical terminal without damaging the terminal or dislodging the terminal from the block. It is apparent, therefore, that the geometry of the pocket and the portions of the electrical terminal to be fitted therein must be such as to secure adequately the terminal to the block during the attachment of electrical conductors to either end of the electrical terminal.

OBJECTS AND SUMMARY OF THE INVENTION

It is a general object of the present invention to provide an electrical connector comprising an insulator block and an electrical terminal, means for retaining the terminal in the block, means for terminating an electrical conductor, the terminal including means for stripping an insulation covering upon the conductor and establishing an electrically acceptable connection between conductor and terminal, by the application of force upon a conductor pressing it into the terminal.

A more specific object of the present invention is to provide an electrical connector, in accordance with the foregoing object, wherein the means for retaining the terminal within the block are suitable to withstand the insertion forces required to strip and seat conductors at either end of the terminal.

Still another object of the present invention is to provide an electrical connector in accordance with the foregoing objects wherein the terminal is so constructed that insertion thereof into the block may be accomplished without damaging or deforming the terminal and yet the terminal is retained in the block so as to withstand the insertion forces required to strip and seat a conductor thereon.

Briefly then, in accordance with the foregoing objects, an electrical connector in accordance with the present invention comprises a dielectric plastic connector block having an opening therein to accept an electrically conductive terminal. The terminal is provided with portions projecting outwardly of the block at either end of said opening, the projections having means for terminating electrical conductors thereon. The portion of the terminal within the block is provided with opposed side faces, and means for retaining the terminal in the block, comprising at least two opposed bosses projecting laterally from the opposed side faces and being imbedded in the plastic of the block within the opening therein.

A preferred embodiment of an electrical connector in accordance with the present invention further includes four bosses projecting laterally from the opposed side faces of the portion of the terminal within the block. The four bosses are disposed in pairs upon each of the opposed side faces of the terminal so as to define substantially the corners of a rectangle, the pair of bosses on each face being diagonally opposed. The opening in the block to accept the terminal is provided with a first portion extending inwardly from the block face which is substantially wider than the thickness of the terminal at the bosses or projections thereon and a second section disposed substantially about the center of the opening that is wider than the thickness of the terminal not including the bosses thereon but narrower than the thickness of the terminal at the bosses. The opening in the block may also be provided with stop means such as a shoulder at the central portion of the opening to engage edges of the intermediate part of the terminal for inhibiting the removal of the terminal from the block through the opening. In a preferred embodiment the bosses may be provided with an end surface that tapers toward the adjacent surface from which the boss projects, the diagonally opposed bosses each tapering in opposite directions. Also, the means for terminating an electrical conductor on the terminal comprise, in a preferred embodiment, opposed cantilever arms that define a notch for receiving an insulated conductor and a slot for receiving a base conductor part hereof. This arrangement provides the means for receiving and holding the conductor and stripping and insulation therefrom by the application of a force upon the conductor and the terminal in a direction toward the block.

Other objects and advantages of the present invention will become apparent from the following detailed description with reference to the several figures of the drawings.

BRIEF DESCRIPTION OF THE FIGURES

FIG. 1 is a fragmentary side elevation, partially in section of an electrical connector incorporating features of the present invention;

FIG. 2 is a fragmentary sectional view along line 2—2 of FIG. 1;

FIG. 3 is a top plan view of the structure of FIG. 2;

DETAILED DESCRIPTION

Figure 4:
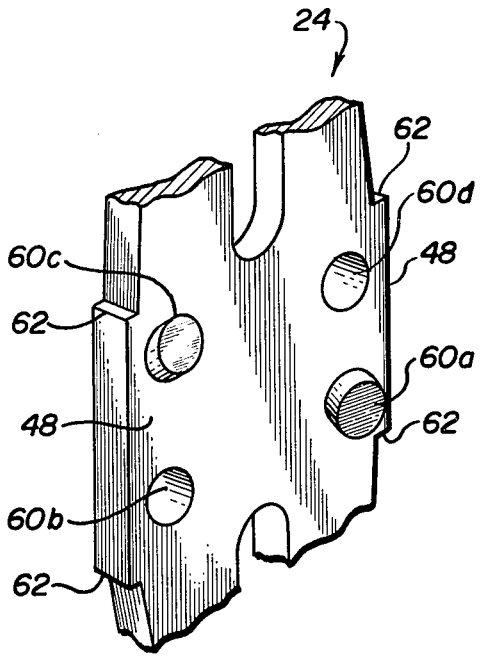
FIG. 4 is a perspective view of a middle portion of an electrical terminal having bosses thereon, which form part of the invention.

Referring now in more detail to the drawings, there is shown an electrical connector comprising a connector block 22 of dielectric plastic material such as thermoplastic or thermosetting resin, glass fiber reinforced resin, etc., and a terminal 24 of electrically conductive material. As seen in FIGS. 1 and 2, formed in the block 22 and exposed to the opposite faces 26, 28 is an opening 30 that extends between the faces 26 and 28 and includes a central pocket 31.

Mounted within the opening 30 of the block 22 is the terminal 24 which is formed from a flat piece of conductive material such as phosphor bronze. The terminal 24 is provided with end portions 32 and 34 projecting outwardly from the opposite faces 26 and 28 of the block 22, which are adapted to receive or terminate a conductor or wire 36 and strip the insulation therefrom. As shown in FIG. 2, each end portion of the terminal 24 is provided with a pair of resilient cantilever arms 38, 40 to receive the conductor 36. The arms 38, 40 define notch 42 and adjacent slot 44 as well as an elongated opening 46 that extends from the slot 44 to the central or intermediate portion 48 of the terminal 24. The notch 42 is wider than the conductor 36 including its insulation. The width of the slot 44 is substantially less than the width of the conductor 36, as determined by a coining or stamping 50 immediately adjacent to the opening 46. The inner end of the notch 42 is formed with sharp corner edges, as is known in the art, to effect slicing of the insulation from a conductor 36 by the application of force thereto in the direction toward the block, as shown in FIG. 1.

Figure 5:
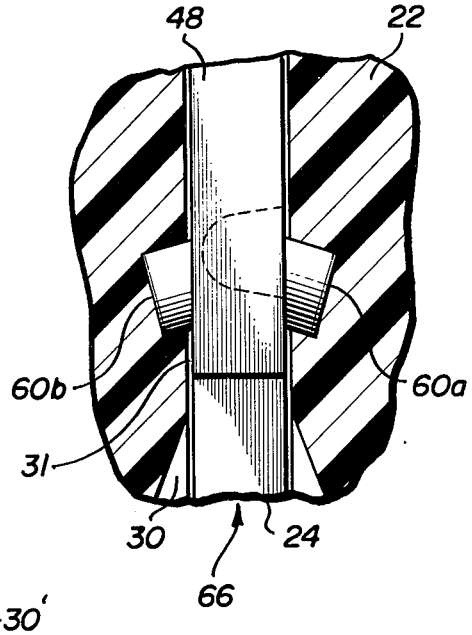
FIG. 5 is an enlarged fragmentary portion of FIG. 1.

Means are also provided for retaining the terminal 24 in the opening 30. At least two opposed bosses 60*a*–60*d* project laterally from opposed side faces at the central or intermediate portion 48 of the terminal 24, as best seen in FIG. 4. In the preferred embodiment the bosses are four in number and are disposed in pairs upon the opposed side faces of the central portion 48 of the terminal 24 so as to substantially describe a rectangle thereon, the pair of bosses on each side face being diagonally disposed. The bosses are substantially cylindrical in shape and are so formed as to be set laterally at a slope or angle with respect to the side faces of the terminal so that the end surfaces of the bosses taper toward the side faces from which they project. Bosses 60*a* and 60*b* slope toward end 28 and bosses 60*c* and 60*d* toward end 26 of the block. The central portion 48 of the terminal 24 is also provided with projecting edge parts 62 to form four corners thereof giving the central portion 48 a substantially rectangular shape. The terminal 24 may then be interference or press-fitted in a retaining pocket 31 in the block 22 so as to be retained therein. As the central portion 48 of the terminal 24 reaches the central portion or retaining pocket 31 of the opening 30, the plastic in the sides of the pocket 31 deforms slightly to allow passage of the somewhat wider central portion 48 of the terminal clip therethrough as best seen in FIG. 2. The bosses pass through a relatively wide outer portion of the opening 30 unobstructed. The retaining pocket 31, however, is narrower than the thickness of the terminal 24 including the bosses 60*a*–60*d* and therefore the bosses 60*a*–60*d* are forced into and deform somewhat the plastic material on the interior of the pocket 31. Over a period of time the plastic insulator material recovers behind the bosses, thereby increasing the retention force holding the terminal 24 in place. It is apparent that as the terminal is inserted, for example from the end face 26 of the opening 30, the slope of the lower pair of bosses 60*a* and 60*b* minimizes skiving of the retaining pocket 31 upon entry, as best seen in FIG. 1. As shown in FIG. 5, the slope of the lower bosses 60*a* and 60*b* also allows enough material support above them after their passage through the plastic material and the recovery thereof, to withstand substantial force applied in a direction indicated by arrow 66 (FIG. 5), such as when pushing a wire 36*a* (FIG. 1) into the lower portion 34 of the terminal 24 therebelow. The upper pair of bosses 60*c* and 60*d* as seen in FIG. 1, due to the diagonal arrangement of bosses 60*a*–60*d* on opposite surfaces of the terminal 24 as described above, have undisturbed material therebelow. Thus, these upper bosses 60*c* and 60*d* will withstand a substantial loading force pressing down upon the terminal 24 such as when the wire 36 is pressed into the upper portion 32 of the terminal 24. The geometry of the opening as shown best in FIGS. 1, 2 and 3, provides sufficient width to lower the forces needed to insert and seat the terminal 24 in its retaining pocket 31 therein, while being sufficiently narrow to adequately retain the terminal once inserted. The H cross section of the pocket as seen best in FIG. 3, is of suitable dimensions to allow the tool forming the pocket to withstand the pressures of the plastic material flowing around it during the molding of the block. The diagonally opposed on opposite sides placement of the bosses 60*a*–60*d* also tends to equalize the forces acting upon the terminal 24 during insertion which tend to tilt or bend the terminal. Thus the terminal 24 is less susceptible to damage or deformation during the insertion thereof into the retaining pocket 31.

Figure 8:
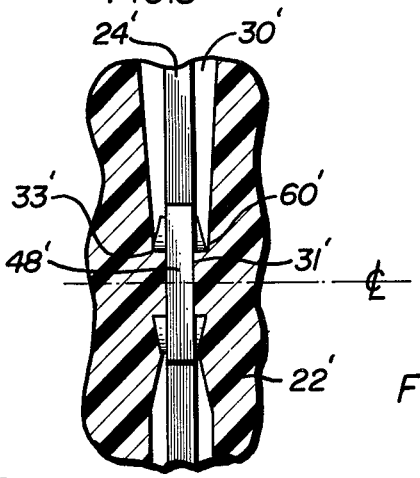
FIG. 8 is a fragmentary side elevation of a second embodiment of an electrical connector incorporating features of the present invention.

FIG. 8 shows an alternative embodiment of the connector, including opening 30′ and retaining pocket 31′ in block 22′. In this configuration, the opening 30′ is of sufficient width to allow the top pair of bosses 60′ of the terminal 24′ to seat at the top of the retaining pocket 31′ on shoulders 33′ with undisturbed material thereunder to withstand a substantial force exerted upon the top end of the terminal 24′.

Figure 6:
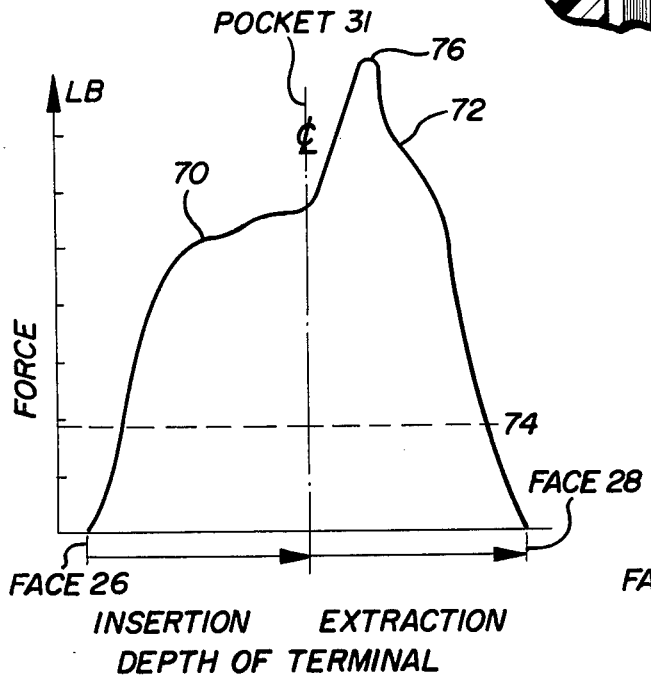
FIGS. 6 and 7 are graphic representations of forces of insertion and retention of an electrical terminal in an insulator block forming the electrical connector according to the present invention.
Figure 7:
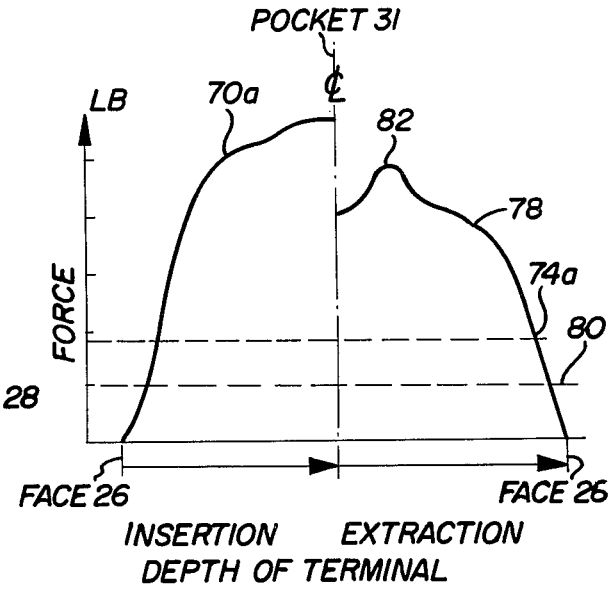

Referring now to FIG. 6 and FIG. 7, forces of insertion and of retention or of extraciton of the terminal clip 24 in the block 22 and retaining pocket 31 thereof are shown in graph form. Referring specifically to FIG. 6, curve 70 represents the force gradient of insertion of the terminal clip 24 from the face 26 of the opening 30 to its centered or assembled position in the pocket 31. The curve 72 represents the force gradient of extraction of the terminal clip 24 from its assembled position in the pocket 31 through the face 28 of the opening 30. The line 74 represents a maximum installation force for a 20 AWG conductor at the end portion 32 of the terminal clip 24, as for example, wire or conductor 36 of FIG. 1. It is apparent then, that the force required to begin extraction of the terminal toward the face 28, at peak 76 of the curve 72 is far in excess of the installation force 74 of the conductor tending to push the terminal in this direction. Therefore, the terminal clip 24 is easily retained in the block 30 while the conductor is being installed on the end portion 32 thereof. It is contemplated that the conductor 36 installed upon the end portion 32 of the terminal clip 24 will commonly be a 20 AWG conductor or smaller, although it is obvious from the force curves that a larger conductor can also be accommodated without dislodging the terminal clip.

Referring now specifically FIG. 7, the curve 70*a* represents the insertion force of the terminal clip 24 from the face 26 of the opening 30 to seating in the pocket 31. This is the same curve as curve 70 of FIG. 6. The curve 78 represents the force gradient of extraction of the terminal clip 24 from its assembled position in the pocket 31 back to the face 26 from which it was inserted. Line 80 represents the installation force of a 26 AWG conductor upon the end portion 34 of terminal clip 24 as, for example, the conductor 36*a* of FIG. 1. It is apparent from curve 78 that the force needed to begin extraction of the terminal clip 24 from the pocket 31 at peak 82 is far in excess of the force of installation 80 and therefore the terminal clip will not be moved by installation of a 26 AWG conductor on the end 34 thereof which force tends to push the terminal clip 24 towards the face 26 of the block. It will be noted that a 26 AWG conductor is the size of conductor commonly installed on the end portion 34 of the terminal clip 24. It is obvious, however, that a larger conductor may be installed thereon as, for example, a 20 AWG conductor whose force of installation is represented by line 74*a*, without dislodging the terminal clip in the direction of the face 26 of the block.

While particular embodiments of the invention have been shown and described herein, it should be understood that many modifications may be made without departing from the spirit and scope of the invention as set forth in the appended claims.

The invention is claimed as follows:

1. An electrical connector comprising a dielectric plastic connector block having an opening, and an electrically conductive terminal in said opening and having a portion thereof projecting outwardly of the block at said opening, said outwardly projecting part having means for terminating an electrical conductor, the part of said terminal within said block having opposed side faces, and means for retaining the terminal in said block, said retaining means including a plurality of bosses projecting laterally from said opposed side faces and being embedded in the plastic of the block at said opening said bosses being four in number and defining substantially the corners of a quadrilateral, one pair of bosses diagonally disposed on one side face and projecting in one direction and the other pair of bosses diagonally disposed on the other side face and projecting in an opposite direction.

2. An electrical connector according to claim 1 in which said terminal has another part projecting outwardly of said block in a direction opposite to the direction of projection of said first-mentioned outwardly projecting part, said other projecting part having means for termination of a wire.

3. An electrical connector according to claim 2 in which said means for termination of a conductor at each projecting part of the terminal includes a pair of arms with means receiving and stripping the insulation from a conductor by the application of force in the direction toward said block, and said retaining means cooperating with said block to prevent removal of the terminal when a wire is terminated at either of said projecting parts.

4. An electrical connector according to claim 3 in which said retaining means further include projecting edge parts formed in an intermediate portion of said terminal in the plane of said side faces and shoulders formed in an intermediate portion of said opening to engage said edge parts.

5. An electrical connector according to claim 3 in which said bosses are formed at an angle with respect to the side faces, each boss having an end surface that tapers toward the side face from which it projects, the diagonally opposed bosses tapering in opposite directions, for allowing said retaining means to cooperate with the block to withstand a greater force imposed against one projecting part and toward the block than against the other projecting part and toward the block, and to equalize forces acting upon said terminal during insertion thereof into the block for minimizing damage or deformation to the terminal during said insertion.

6. An electrical terminal comprising a flat generally planar conductive body having opposed ends with wire termination means thereat, each wire termination means comprising opposed cantilever arms that define a notch for receiving an insulated conductor and a slot for receiving a bare conductor part, the cantilever arms being on a common base constituting a part of the terminal that is intermediate the opposed ends, said common base having bosses projecting from the plane of the body, the bosses being four in number and defining substantially the corners of a rectangle, one pair of diagonally disposed bosses projecting in one direction and the other pair of diagonally opposed bosses projecting in the opposite direction.

7. A terminal according to claim 6 in which the bosses each have an end surface that tapers toward the adjacent surface from which the boss projects, the diagonally opposed bosses tapering in opposite directions.

8. An electrical connector comprising a plastic dielectric connector block having opposite faces and an opening running from one face to the other face, and a substantially flat terminal in said opening having wire termination means projecting from said opposite faces, said terminal having an intermediate part with opposed bosses projecting laterally therefrom said projecting edge parts, said opening also having an intermediate section that is interior of the block and is wider than the thickness of said intermediate part of the terminal remote from said bosses but narrower than the thickness of said intermediate part at said bosses, shoulder means at said intermediate interior section engaging the edge parts of said intermediate terminal part for inhibiting removal of the terminal from said block through said opening at either face, and said bosses being embedded in the plastic at said intermediate interior section further to aid in inhibiting removal of said terminal at either face.

9. An electrical terminal comprising a flat generally planar conductive body having opposed ends with wire termination means thereat, each wire termination means comprising opposed cantilever arms that define a notch for receiving an insulated conductor and a slot for receiving a conductor part, the cantilever arms being on a common base constituting a part of the terminal that is a section intermediate the opposed ends, said intermediate section having bosses projecting from the plane of the body for embedment in the material of a connector block, said bosses including one pair of diagonally disposed bosses projecting in one direction and another pair of diagonally disposed bosses projecting in the opposite direction, said intermediate section being of generally rectangular configuration having corner edge portions for engagement with shoulder portions of the connector block whereby the bosses and edge portions cooperate with the connector block to retain the terminal in the connector block.

10. An electrical connector comprising a plastic dielectric connector block having opposite faces and an opening running from one face to the other face, and a substantially flat terminal in said opening having wire termination means projecting from said opposite faces, each said wire termination means including a pair of arms with means for receiving and stripping the insulation from a conductor by the application of a force in the direction toward said block, said terminal having an intermediate part with opposed bosses projecting laterally therefrom and projecting edge parts in the plane of said flat terminal at an intermediate portion thereof, said opening having first and second sections extending inwardly from the respective block faces and being substantially wider than the thickness of said terminal at said bosses, said opening also having an intermediate third section that is slightly wider than the thickness of said intermediate part of the terminal remote from said bosses but narrower than the thickness of said intermediate part at said bosses, shoulder means at said third section engaging the edge parts of said intermediate terminal part for inhibiting removal of the terminal from said block through said opening, and said bosses being embedded in the plastic at said third further to aid in preventing removal of said terminal, the embodiment of said bosses serving to withstand a greater force imposed against one wire termination means and toward the block than against the other wire termination means and toward the block.

* * * * *

UNITED STATES PATENT AND TRADEMARK OFFICE

CERTIFICATE OF CORRECTION

PATENT NO. : 4,106,837

DATED : August 15, 1978

INVENTOR(S) : Edward S. Paluch

It is certified that error appears in the above-identified patent and that said Letters Patent are hereby corrected as shown below:

Col. 4, line 43, "extraciton" should be -- extraction--;

Col. 4, line 67, after "specifically" insert --to--;

Col. 6, line 35, "said" should be --and--;

Col. 8, line 8, after "third" insert --section--;

Col. 8, line 9, "embodiment" should be --embedment--.

Signed and Sealed this

*Sixth* Day of *March 1979*

[SEAL]

*Attest:*

RUTH C. MASON
*Attesting Officer*

DONALD W. BANNER
*Commissioner of Patents and Trademarks*